United States Patent [19]

Ikeda et al.

[11] Patent Number: 4,545,725

[45] Date of Patent: Oct. 8, 1985

[54] STRESS CORROSION CRACKING PROOF STEAM TURBINE

[75] Inventors: Takashi Ikeda, Tokyo; Masachika Odawara, Kanagawa, both of Japan

[73] Assignee: Tokyo Shibaura Denki Kabushiki Kaisha, Kawasaki, Japan

[21] Appl. No.: 571,796

[22] Filed: Jan. 18, 1984

[30] Foreign Application Priority Data

Jan. 24, 1983 [JP] Japan ..... 58-9645

[51] Int. Cl.[4] ..... F01D 5/08; F01D 25/12

[52] U.S. Cl. ..... 415/180; 415/117; 415/168; 415/176

[58] Field of Search ..... 415/116, 175, 176, 180, 415/115, 117, 168, 199.5

[56] References Cited

U.S. PATENT DOCUMENTS

| | | | |
|---|---|---|---|
| 2,738,949 | 3/1956 | Wilkinson | 415/180 |
| 2,741,455 | 4/1956 | Hunter | 415/116 |
| 3,551,068 | 12/1970 | Scalzo et al. | 415/116 |
| 3,945,758 | 3/1976 | Lee | 415/116 |

*Primary Examiner*—Robert E. Garrett

*Assistant Examiner*—H. Edward Li

*Attorney, Agent, or Firm*—Cushman, Darby & Cushman

[57] ABSTRACT

A stress corrosion cracking proof steam turbine in which dry steam is blown into the gap between the hub portions of adjacent turbine discs, thereby preventing corrosion in the gap. A nozzle diaphragm is provided between the discs and has an inside circumferential face which straddles the gap. Labyrinthine packing is provided on the inside face of the nozzle diaphragm and comprises an upstream, an intermediate, and a downstream group of fins. A steam reservoir is located between the intermediate and downstream group of fins and straddles the gap. A steam supply means is located inside the nozzle diaphragm and provides dry steam (from inside or outside the turbine) to the reservoir and thus to the gap. To prevent leakage of high pressure wet steam into the reservoir, a steam leakage capturing means is provided between the upstream and the intermediate group of fins. This capturing means is connected to the low pressure side of the diaphragm via a steam leakage bypass means, thereby preventing high pressure wet steam from entering the reservoir.

12 Claims, 11 Drawing Figures

STRESS CORROSION CRACKING PROOF STEAM TURBINE

BACKGROUND OF THE INVENTION

This invention relates in general to steam turbines. More specifically, the present invention is directed to structural arrangements for steam turbines. The turbine arrangement disclosed eliminates stress corrosion cracking with a novel structural arrangement including a shrinkage-fitting rotor.

Various types of steam turbine rotors are known. These include: rotors manufactured from integrally forged alloy steel or similar raw material by mechanical working of the steel or raw material; rotors manufactured by welding disc-shaped raw material to produce an integral whole, which integral whole is then subjected to mechanical working; and rotors produced by shrinkage-fitting onto a rotor shaft a disc in which blades have been anchored after completion of mechanical working. Of these various known turbine arrangements, the shrinkage-fitting type has become widely accepted because large rotors can be manufactured from forged material of comparatively small dimensions, since the material is divided between the rotor shaft and a plurality of discs.

FIG. 1 (PRIOR ART) shows an example of a typical shrinkage-fitted rotor. A plurality of discs 3, each of which has a multiplicity of blades 2 mounted about its periphery, are fitted onto a rotor shaft 1. For each disc 3, the internal diameter $d_1$ of the disc is made smaller, at room temperature (based on known shrinkage fitting diameter proportion relationships), than the external diameter $d_2$ of the rotor shaft at the location of mounting of the disc on rotor shaft 1. When discs 3 are to be coupled to rotor shaft 1, only the discs are heated and expand thermally so that the internal diameter $d_1$ of a particular disc 3 becomes larger than the external diameter $d_2$ of rotor shaft 1 at the mounting position. With the internal diameters of discs 3 thus expanded, the rotor shaft 1 is inserted through each of the discs, positioned appropriately, and the discs are then made to contract by cooling them, thereby fixing them securely to rotor shaft 1.

Disc bore keys 4 are provided at the junction of each of discs 3 and rotor shaft 1, so that even if, under exceptional turbine operating conditions, the shrinkage fit should loosen, the discs cannot move relative to the rotor shaft 1.

Problems exist in the use of known shrinkage fit rotors, as described above. In such shrinkage-fitted rotors, there is a risk of development of corrosion cracks in the rotor shaft or in the discs due to stress under the special steam environment which exists during operation of the turbine. These corrosion cracks may shorten the rotor life and adversely affect its reliability.

One mechanism which results in the development of such stress corrosion cracks involves local breakdown of a surface oxide layer of the metal in the oxygen-containing water or steam environment which exists during turbine operation. This causes cracks due to selective dissolving of the affected metal portions under the action of tensile stress on the material. Stress corrosion cracking occurs when there is a coincidence of the following three factors: sensitivity of the material to cracking; stress higher than a critical value; and the material being placed in an environment wherein local formation and breakdown of the oxidation layer occurs.

The sensitivity of the material to stress corrosion cracking has a close relationship with the strength of the material. In general, the higher the tensile strength of the material, the greater is its sensitivity to cracking. However, for shrinkage-fitted rotor discs, low alloy steel of high tensile strength must be used because of the high stress to which the discs are subjected. This results in a high cracking sensitivity. It is believed that, in the future, selection or development of materials that have no cracking sensitivity at all will be practically impossible.

Also, the discs of a shrinkage-fitted rotor are subjected to a shrinkage-fitting stress caused by the initial shrinkage fitting of the discs to the rotor, and to centrifugal stress accompanying the rotation that acts on the discs themselves and on the blades. The value of this stress increases in the radially inwards direction of the discs. In particular, stress concentration occurs, due to the shape, in the regions of the key grooves where the disc bore keys 4 used for position locking the discs to the rotor shaft 1 are mounted. This stress may often exceed the critical value for stress-induced corrosion cracking.

The properties of the steam in a power generating installation in which the turbine is used are fixed by the overall design specifications of the reactor, boiler or the like steam generating equipment and the condensing plant or water-supply, etc., used in the power generating installation. It is therefore difficult to sufficiently control water quality to prevent stress-induced corrosion cracking of discs 3.

Thus in general, due to the combination of the three factors of the material, stress, and environment in the neighborhood of the key grooves of the discs of a shrinkage-fitted rotor, there is a considerable likelihood of occurrence of stress-induced corrosion cracking. If such stress corrosion cracks occur in the discs, and are not detected before rotor use by non-destructive testing etc., they may even lead to destruction of the discs 3.

SUMMARY OF THE INVENTION

Accordingly, the present invention provides a new and improved structural arrangement for a steam turbine. More specifically, the invention provides a stress corrosion cracking proof steam turbine arrangement. The steam turbine has a shrinkage fitting rotor and functions with good reliability while avoiding the occurrence of stress corrosion cracks which normally occur in known shrinkage fitting rotor arrangements.

The steam turbine according to the invention includes an arrangement whereby dry steam is blown down upon a gap which exists between the both end faces of the hub of adjacent discs which are mounted upon the periphery of a rotor shaft, from the interior or the exterior of the turbine. Steam leakage that flows down between a group of upstream fins of a labyrinthine packing and the disc hubs is allowed by bypass the gap between adjacent hubs and flow out to a low-pressure region.

DETAILED DESCRIPTION OF THE PREFERRED EMBODIMENT

The presently preferred embodiment of the invention is explained below with reference to FIG. 2 to FIG. 11.

Figure 1:
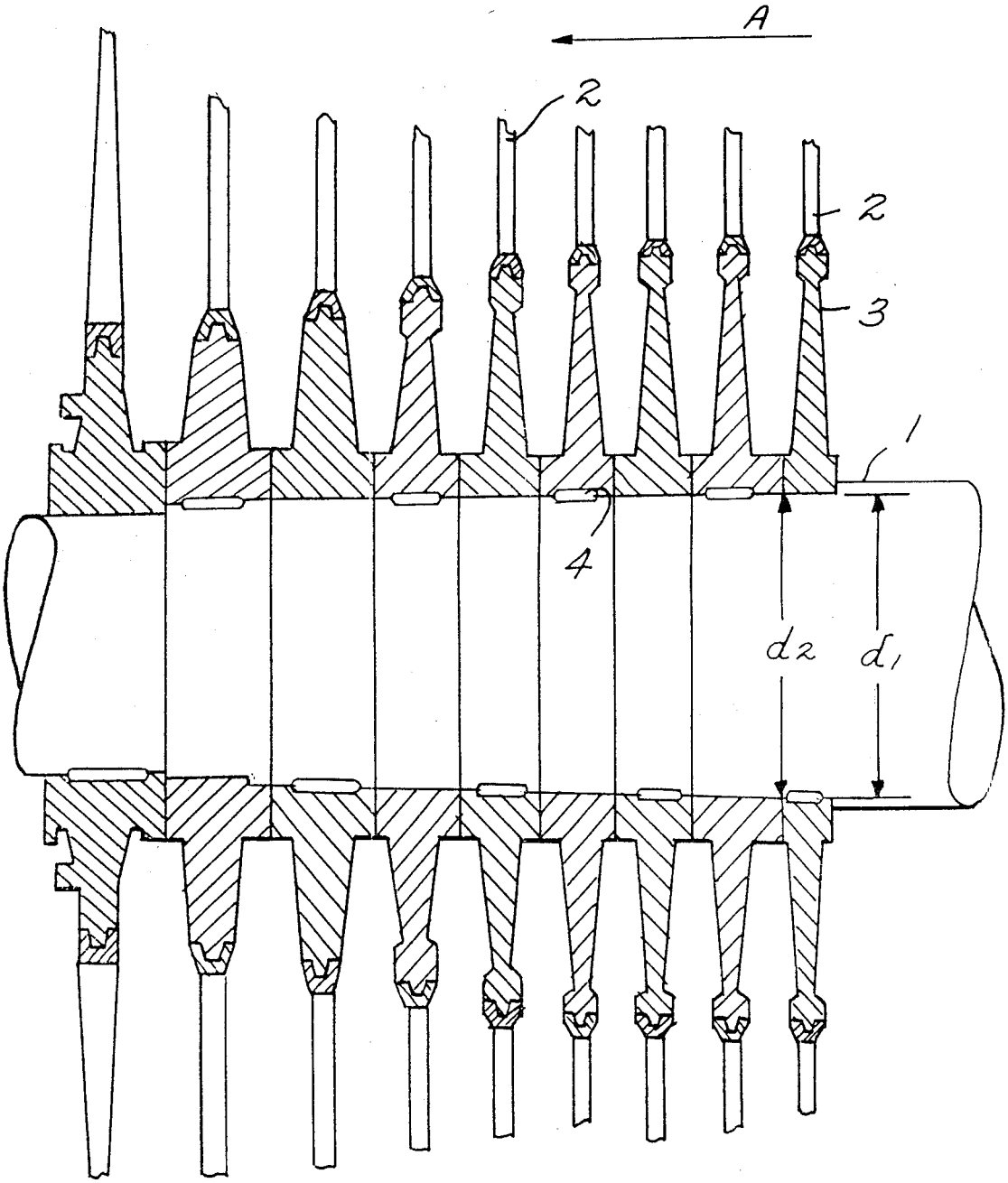
Fig. 1. (PRIOR ART)
FIG. 1 (PRIOR ART) is a side sectional view showing a known steam turbine rotor.
Figure 2:
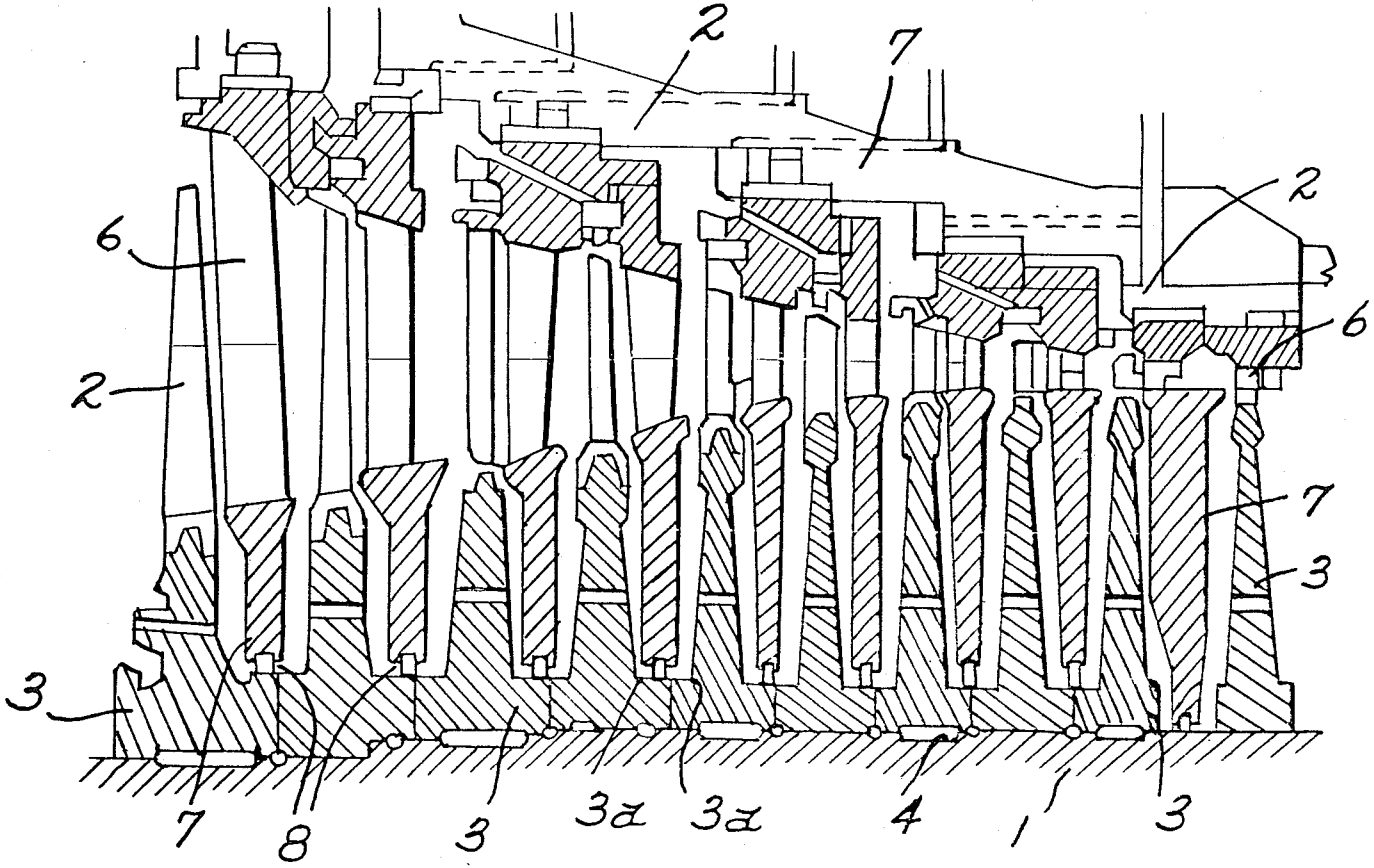
FIG. 2 is a diagrammatic side sectional view of a turbine according to this invention.
Figure 3:
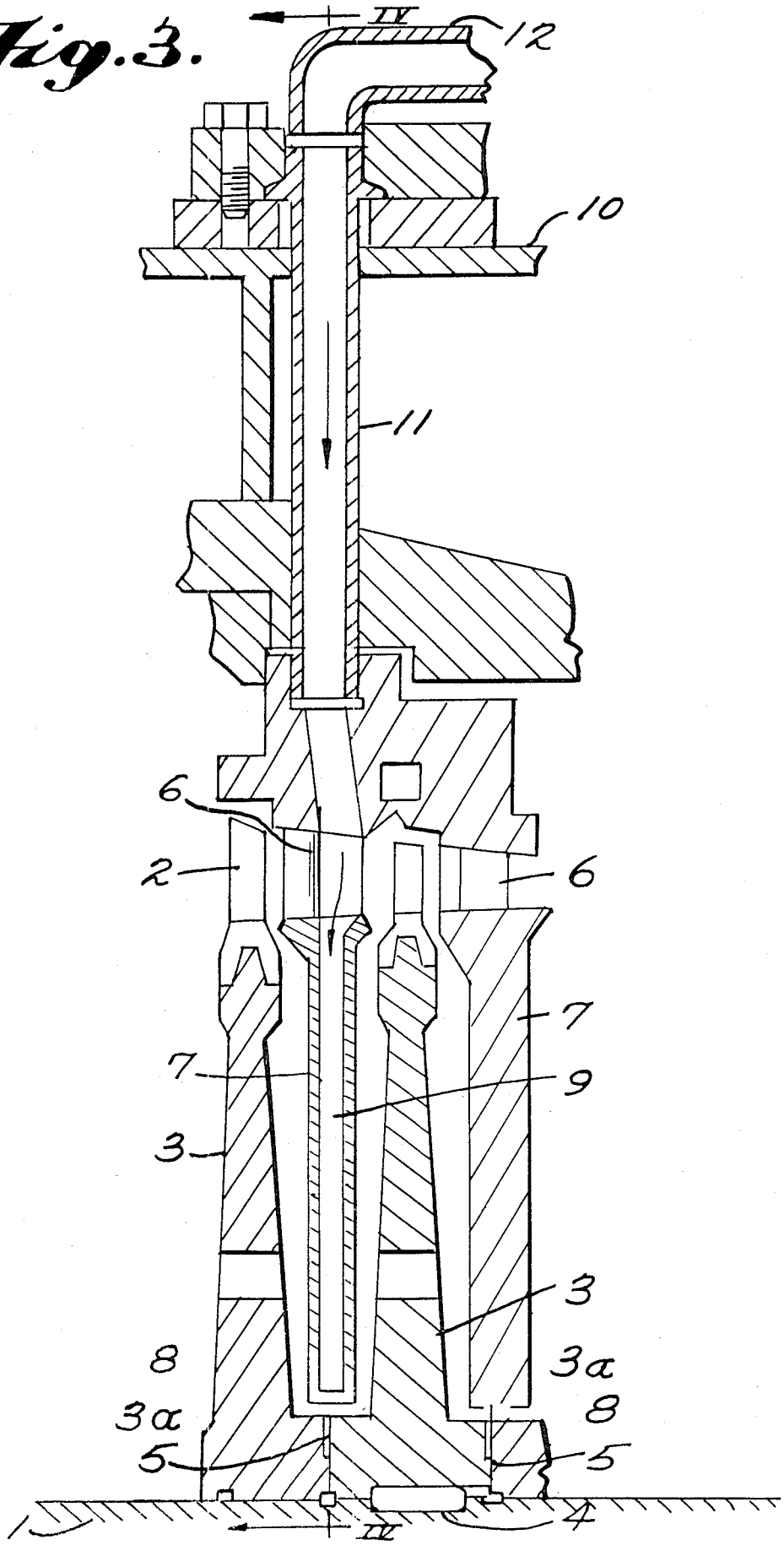
FIG. 3 is a diagrammatic side sectional view of a neighborhood of a nozzle diaphragm (shown in FIG. 4 having a steam supply hole and drawn to a larger scale than that of FIG. 2.

In FIGS. 2 and 3, discs 3' on the periphery of each of which are mounted a multiplicity of blades 2' are mounted on rotor shaft 1. A very small gap 5 exists between the hubs of adjacent discs. These gaps prevent collision of the hubs on thermal expansion. A gap 5 is provided between respective adjacent end faces of the hubs 3*a* that are located at the radially inner region of each of the discs 3.

Between each pair of adjacent discs 3, 3 there is arranged a diaphragm 7 provided with a nozzle 6 in a position corresponding to blades 2. A labyrinthine packing 8 is mounted on the inside circumferential face of each nozzle diaphragm 7 opposite the outer circumferential faces of associated hubs 3*a* of the discs 3 between which the nozzle diaphragm is positioned.

Figure 4:
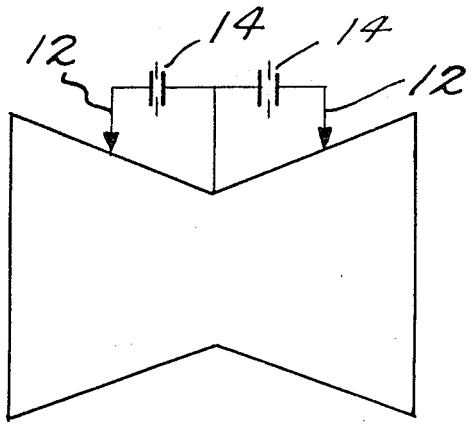
FIG. 4 and FIG. 5 are diagrams illustrating different systems supplying steam to the turbine from a steam supply source.
Figure 5:
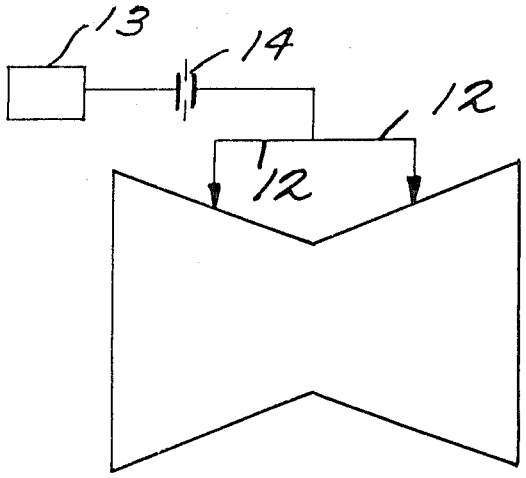

A steam supply hole 9 is formed in the radial direction in the nozzle diaphragm 7 and its outer end is connected to a steam supply pipe 11 that passes through a casing 10 of the turbine. The steam supply pipe 11 is connected to a suitable steam source through a duct 12. The steam source may be steam of higher pressure within the turbine, as shown in FIG. 4, or, as shown in FIG. 5, may be a steam source 13 outside the turbine. In either case, if the steam from the steam source is wet steam containing water droplets, a pressure-reduction orifice 14 is provided in the duct 12 to allow isoenthalpic expansion so that the steam is supplied to the steam supply pipe 11 in the form of superheated steam.

Steam supply hole 9 can be provided with each of nozzle diaphragms 7 or steam supply holes 9 can be provided only with nozzle diaphragms 7 corresponding to particular discs 3 tending to crack due to stress corrosion.

Figure 6:
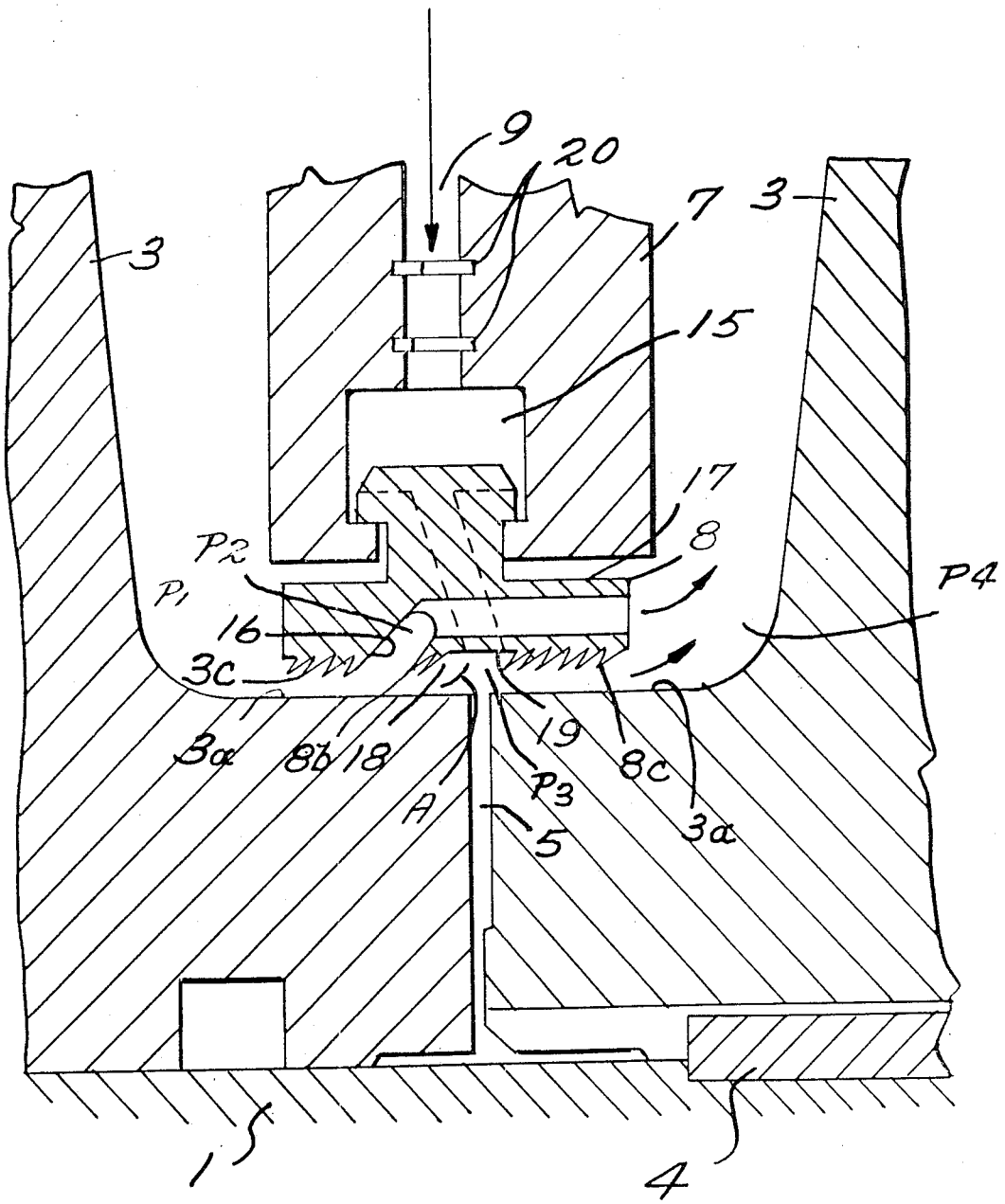
FIG. 6 is a cross-sectional view of the labyrinthine packing of FIG. 2 drawn to a larger scale than that of FIG. 2.

FIG. 6 is a cross-sectional view, drawn to a larger scale, of the region where the labyrinthine packing 8 is mounted. A labyrinthine packing fitting groove 15, into which the steam supply hole 9 opens, is formed in the region of the inner circumference of nozzle diaphragm 7 and the labyrinthine packing 8 is fitted into fitting groove 15.

In labyrinthine packing 8 there are formed, on a face opposite to the inner circumferential surface of the packing the outer circumferential surface of hub 3*a* of the disc 3, in order from the upstream side (high pressure side) of the turbine, three groups of fins 8*a*, 8*b*, and 8*c*. 8*a*, 8*b* and 8*c*, are referred to as "upstream group of fins", "intermediate group of fins" and "downstream group of fins", respectively. The fins in each of groups 8*a*, 8*b* and 8*c* are inclined so that their leading ends point in the upstream direction or higher pressure direction. A steam leakage capturing groove 16 that extends in the circumferential direction is formed in the labyrinthine packing 8 between the upstream group of fins 8*a* and the intermediate group of fins 8*b*. This steam leakage capturing groove 16 has connected to it a plurality of steam leakage bypass passages 17 that are formed in the axial direction of the turbine in the labyrinthine packing 8 and that open at one end into the gap between the disc 3 of an adjacent stage and the nozzle diaphragm 7.

Figure 7:
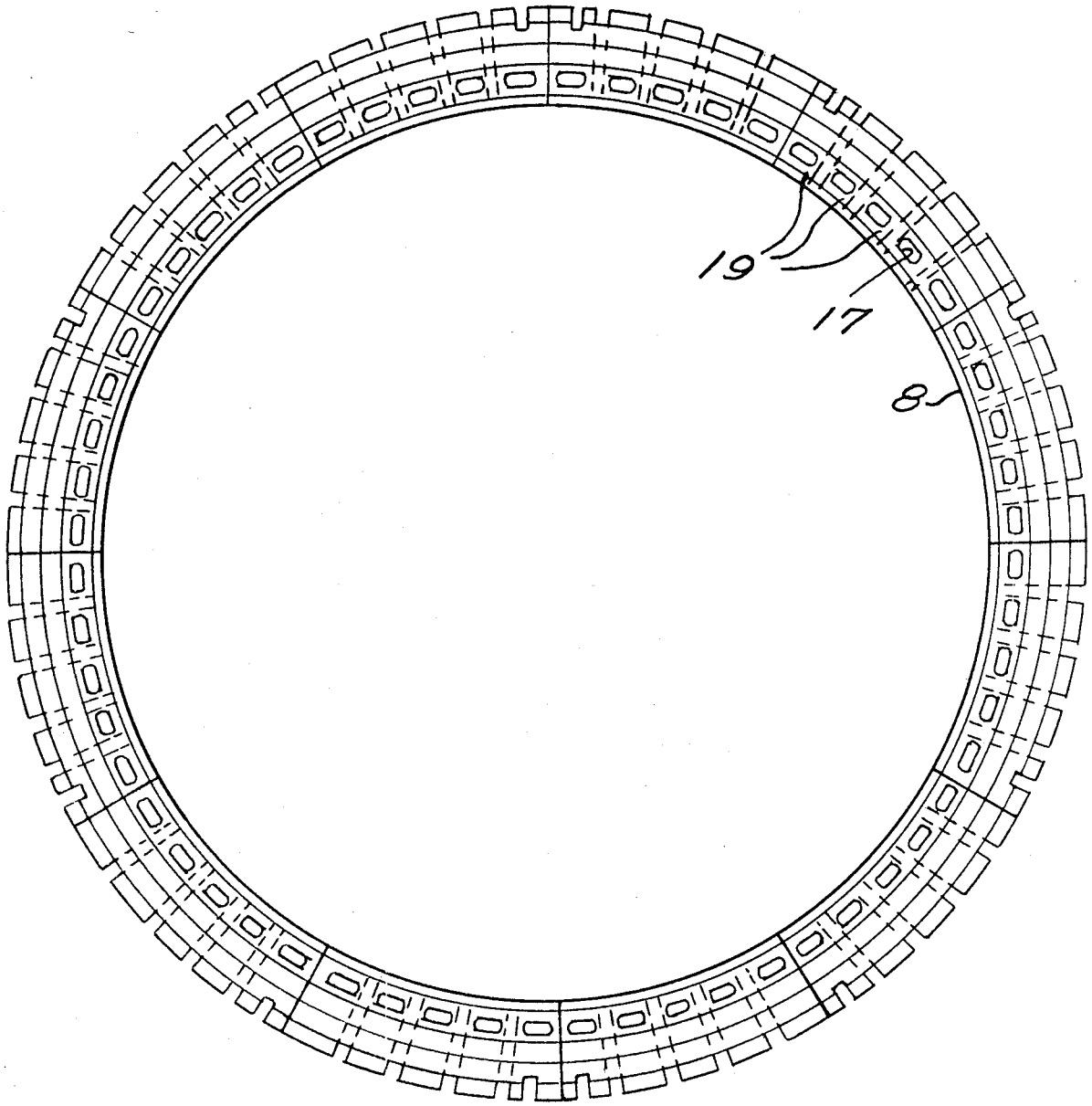
FIG. 7 is a rear view of the labyrinthine packing.

A circumferentially extending annular steam reservoir 18' defined by the downstream group of fins 8*c* and the group of fins 8*b* that is upstream thereof, is formed at a position corresponding to that of the opposing faces of the hubs 3*a*, 3*a* of the adjacent discs 3, 3. A communicating hole 19 that connects the labyrinthine packing fitting groove 15 with the steam reservoir 18 is formed in the labyrinthine packing 8. A pressure reduction orifice 20 changes the wet steam into dry steam. FIG. 7 shows a front view of the labyrinthine packing 8.

During operation of the turbine, most of the steam that is supplied from the steam generator performs its work by passing through blades (vanes) 2, which are not subject to stress corrosion cracking. The remaining 1% (approximately) of the steam will try to leak through the gap between the labyrinthine packing 8 provided in nozzle diaphragm 7 and the circumference of the hub 3*a* of the disc 3.

However, in this case the steam from the steam source, that has been turned into superheated dry steam A, passes through duct 12, steam supply pipe 11, and steam supply hole 9 to be supplied to the labyrinthine packing fitting groove 15, and thence, through the communicating hole 19, and is injected into steam reservoir 18, with the result that the very small gap 5 between hubs 3*a*, 3*a* is filled by the supplied dry steam A.

Some of the dry steam that has flowed into steam reservoir 18 flows past the intermediate group of fins 8*b* into the steam leakage capturing groove 16 and so prevents the moisture containing steam leakage B that has leaked from the region of the upstream fin group 8*a* into the steam leakage capturing groove 16 from entering steam reservoir 18. Thus the steam leakage that has leaked into the steam leakage capturing groove 16 flows through the steam leakage bypass 17, bypassing the steam reservoir 18, and flows out on the low-pressure side of nozzle diaphragm 7. The rest of the dry steam that has flowed into the steam reservoir 18 flows out past the downstream group of fins 8*c* to the downstream low pressure side, meanwhile heating the hub 3*a* of the blade 3.

Figure 8:
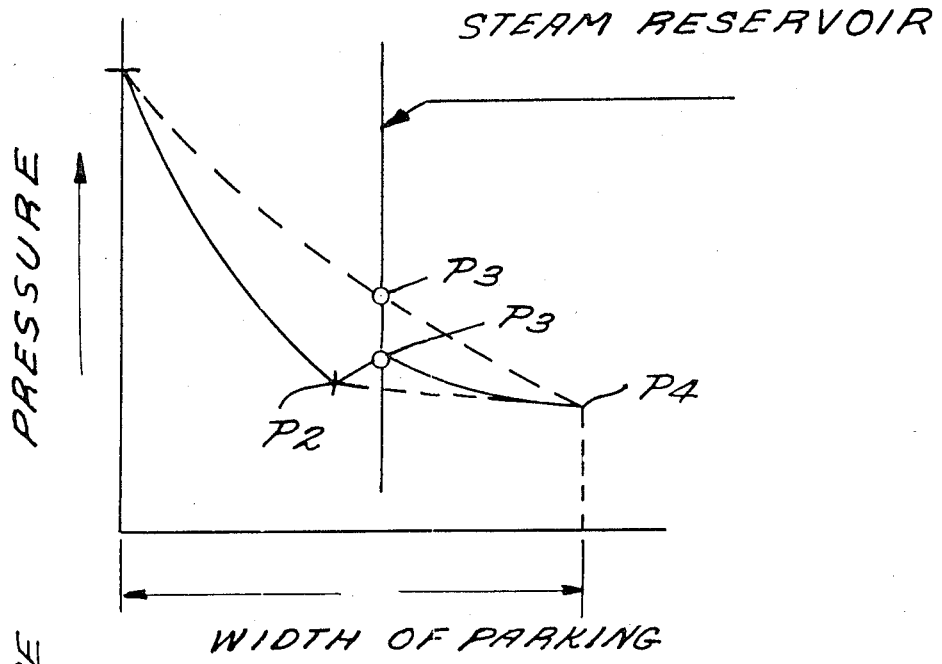
FIG. 8 is a diagram of the pressure distribution in the labyrinthine packing.

The pressure distribution of the various regions of the labyrinthine packing 8 when the steam leakage flows through it is shown in FIG. 8.

In the previous construction, the pressure distribution in the labyrinthine packing, as shown by the double-dotted chain line, varies practically uniformly between the pressure $P_1$ on the upstream side of the labyrinthine packing 8 and the pressure $P_4$ on the downstream side, so that the pressure $P_3'$ in the very small gap 5 between the hubs 3*a*, 3*a* has a value practically intermediate between the upstream pressure $P_1$ and the downstream pressure $P_4$.

The pressure loss of the steam leakage bypass 17 is very small because bypass 17 is provided with labyrinthine packing 8 in the circumferential direction, so the pressure $P_2$ in the steam leakage capturing groove 16 has almost the same value as the pressure $P_4$ that is arrived at by adding this pressure loss to the pressure $P_4$ on the downstream side of the labyrinthine packing 8. Although, as mentioned earlier, the pressure $P_3$ of the very small gap 5 between the hubs 3*a*, 3*a* must be somewhat higher than the pressure $P_2$ of the steam leakage capturing groove 16, by the amount necessary to maintain the flow of steam from the steam reservoir 18 to the steam leakage capturing groove 16, it can be made appreciably lower than the pressure $P_3'$ in the conventional packing.

Figure 9:
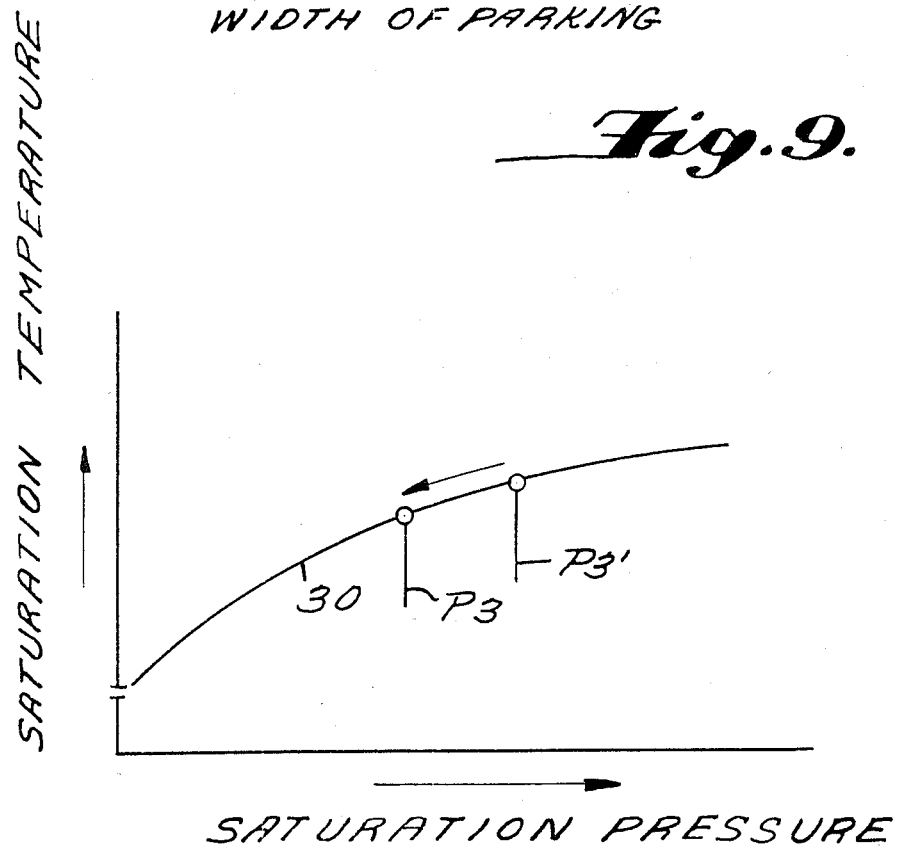
FIG. 9 is a diagram showing the variation of the saturation temperature in the region of the disc hub gap.

Thus the saturation temperature of the steam in the very small gap 5 is, as shown in FIG. 9, several degrees lower than in the conventional device (the pressure in the region is $P_3'$) since the pressure $P_3$ in the steam reservoir 18 according to this invention is lower.

Figure 10:
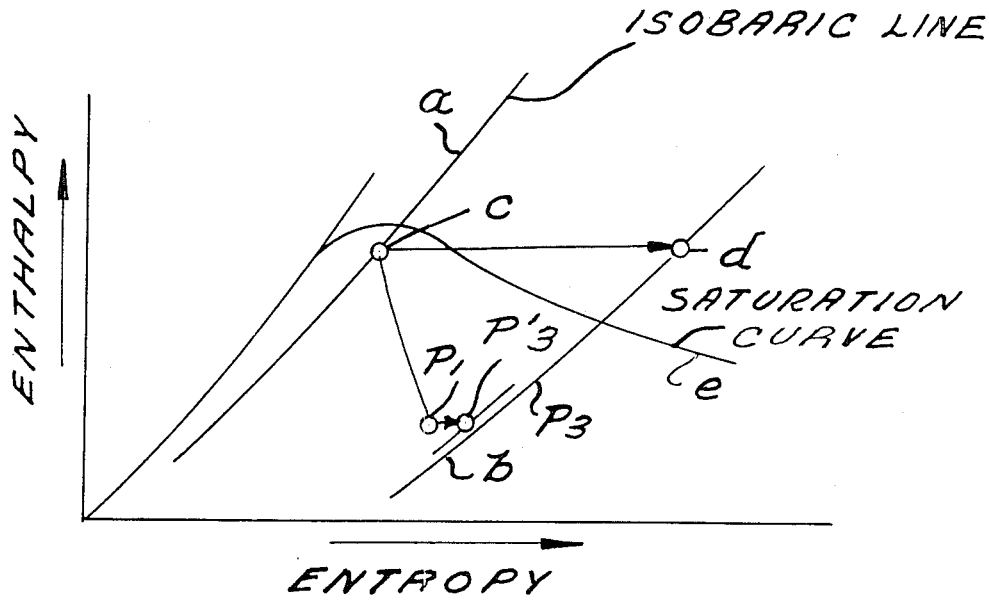
FIG. 10 is a graph showing the variation of steam state in disc hub gap.

The variation of the steam state in the very small gap 5 between the disc hubs is shown in FIG. 10. In this Figure, an example is shown in which the source of steam supply is the steam in the upstream region of the turbine. The steam, which has expanded inside the turbine from the supplied steam source pressure a, expands to the pressure $P_1$ on the upstream side of the labyrinthine packing 8, and then further expands to the pressure $P_3'$ of the very small gap 5 between the disc hubs, as mentioned earlier. Since this steam stage b represents wet steam containing moisture, as mentioned earlier, the steam temperature is uniquely determined by the pressure $P_3'$.

The steam supplied to the steam reservoir 18 expands isoenthalpically from the supplied steam state c to the pressure $P_3$ in the region of the disc hub gap 5, because of pressure-reduction orifice 14. Now even if the state of the steam supplied from the steam source is that of wet steam, during the expansion process it crosses the saturation pressure line e and is thereby turned into superheated steam. Thus, referring to the steam state d in the region of the gap, the steam temperature in this gap between the disc hubs can be made 10°–30° C. higher than in the conventional device.

Consequently, the very small gap 5 between hubs 3*a*, 3*a* becomes filled with drier steam at higher temperature than that of upstream fin group 8*a* and downstream fin group 8*c* which passes through the very small gap 5 and penetrates the key grooves etc.

However, even though the atmosphere of the region of the key grooves consists of superheated steam, in fact, since the temperature of the discs 3 is about 10° C. lower than the steam temperature, if this disc temperature were lower than the saturation temperature of the steam atmosphere, water would condense at the surfaces of the key grooves of the discs 3.

Consequently, water droplets can be prevented from flowing into or being formed in the region of the key grooves, which are thus always in a clean environment. Thus stress corrosion cracking can be prevented, since a factor relating to the environment, which is one of the causes of stress corrosion cracking, is eliminated.

In addition to the above-mentioned three factors related to stress corrosion cracking, there is also a close relationship with the environment temperature. Specifically, the rate of progress of stress corrosion cracking is considerably affected by the environment temperature. The reason for this is that chemical factors are involved in stress corrosion cracking so stress corrosion cracking is promoted in a certain specific temperature region dependent on the relationship between the steam constituents and the chemical properties of the rotor material.

Thus, with this invention, as mentioned above, the temperature of the steam that is supplied to the very small gap between the end faces of the disc hubs is higher than in the conventional device. Also by selection of the temperature of the supplied steam, the temperature of this region can be kept out of the abovementioned specific temperature region. Promotion of stress corrosion cracking can thereby be prevented.

Figure 11:
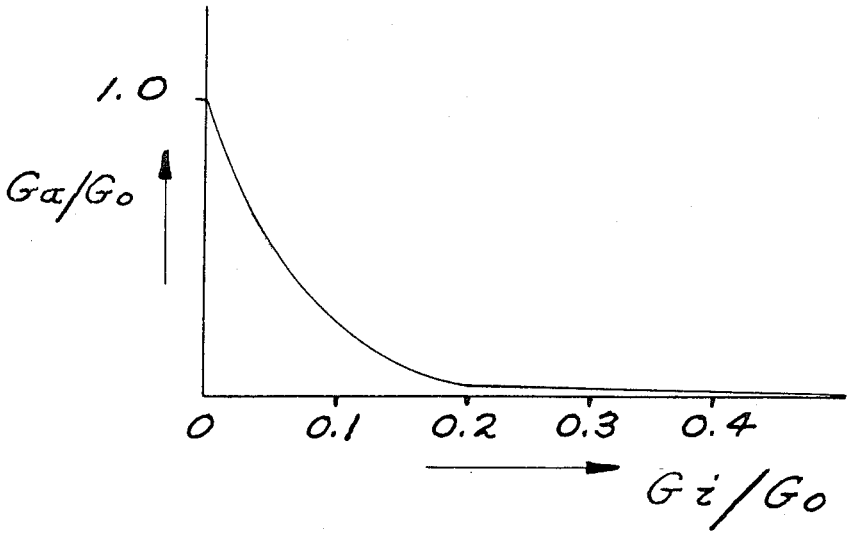
FIG. 11 is a graph showing the relationship between the amount of steam leakage and the amount of steam supplied.

The amount of steam Gi supplied to the steam reservoir 18 from steam supply hole 9 must be determined by taking into consideration the need to prevent steam of the high pressure side of nozzle diaphragm 7 leakage from entering this steam reservoir 18 and also requirements concerning superheating at the disc hubs 3*a*. Gi is closely related to the amount of steam leakage Go which pass between the upstream group of fins 8*a* and discs 3. If we take the amount of steam for which the steam leakage would again flow into the steam reservoir 18 through the intermediate group of fins 8*b* as Ga, the experimental relationship between Ga/Go and Gi/Go is as shown in FIG. 11. From this it can be seen that the effect explained previously can be adequately guaranteed if the amount of supplied steam Gi is made at least 0.2 times the amount of steam leakage Go. In fact an optimum value greater than 0.2 is selected taking into account variation of the labyrinth gap and effects on the turbine performance etc.

It should be noted that this invention is not restricted to the above embodiment. For example, the labyrinthine packing need not be fitted into a fitting groove in the nozzle diaphragm, but could be directly mounted in an internal diameter portion of the nozzle diaphragm etc. Furthermore, if a steam source other than the turbine steam generator is used for supplying steam to the steam reservoir, clean steam that does not contain impurities that constitute one of the causes of corrosion cracking can be supplied to the steam reservoir. Thus one of the causes of corrosion cracking can be removed by supplying this clean steam to the key groove portions etc.

As explained above, with this invention, dried clean steam is supplied to the very small gap between the adjacent disc hubs mounted on the turbine rotor, and the steam which would try to enter this region through the labyrinthine packing is exhausted to the low pressure side through a steam leakage bypass. Thus entry of wet steam or dirty steam through this very small gap into the key grooves can be reliably prevented, and reliability of the shrinkage-fitted rotor can be greatly increased by means of a simple construction and without greatly affecting turbine performance.

What is claimed is:

1. A stress corrosion cracking proof steam turbine comprising:

a casing;

a rotor shaft provided through said casing;

a plurality of discs fitted on said rotor shaft each disc having a hub portion with gaps between the hub portions of adjacent discs, and an inter-disc space between adjacent disc; and a nozzle diaphragm having a nozzle, and mounted within an inter-disc space, said diaphragm including a labyrinthine packing having a plurality of fins, the packing being mounted on an inside circumferential face of said nozzle diaphragm, also including a steam supply passage provided through said nozzle diaphragm for supplying steam that has been converted into a dry state from the interior or the exterior of the turbine into a region between said hubs and said labyrinthine packing, and a steam leakage bypass whereby steam leakage that flow down between group of upstream fins of labyrinthine packing and said hub is conducted away from said gap betweeen hub portions of adjacent discs, thereby preventing corrosion at an interface between hub and rotor.

2. A turbine according to claim 1, wherein said packing comprises three groups of fins which are arranged in an axial direction.

3. A turbine according to claim 1, wherein an upstream end of said steam leakage bypass is connected to an annular steam leakage capturing groove formed immediately downstream of said upstream group of fins.

4. A turbine according to claim 2, wherein a downstream end of said steam leakage bypass opens into a space formed by the disc on a low-pressure side and said nozzle diaphragm.

5. A turbine according to claim 1, wherein at least one row of fins are provided between the upstream end of said steam leakage bypass and said region.

6. A turbine according to claim 1, further comprising at least one additional plurality of nozzle diaphragms which are mounted within a plurality of gaps.

7. In a steam turbine comprising a rotor shaft and a plurality of discs having hub portions fitted to said shaft, an interdisc gap located between hub portions of adjacent discs, and an interdisc space located between adjacent discs, apparatus for preventing corrosion at said gap comprising:

a nozzle diaphragm mounted within said space and having a high and a low pressure side and an inside circumferential face straddling said gap;

labyrinthine packing mounted on said inside face and having upstream, intermediate, and downstream groups of fins;

a steam reservoir located between said intermediate and said downstream groups of fins and in communication with said gap;

steam leakage capturing means, located between said upstream and said intermediate groups of fins, for capturing high pressure steam leaking from said high pressure side past said upstream group of fins;

steam leakage bypass means for providing communication between said capturing means and said low pressure side and for preventing said high pressure steam from entering said reservoir; and steam supply means, connected to said diaphragm, for supplying dry steam to said reservoir and thereby to said gap to prevent corrosion in said gap.

8. Apparatus according to claim 7 wherein said dry steam is provided from a source external to said turbine.

9. Apparatus according to claim 7 wherein said dry steam is provided from a high pressure steam source within said turbine.

10. Apparatus according to claim 7 further including pressure reduction means located in said steam supply means for converting wet steam into dry steam.

11. Apparatus according to claim 7 wherein said steam supply means is a passageway within said diaphragm.

12. Apparatus according to claim 7 wherein said turbine includes more than two discs and wherein one said diaphragm and its associated labyrinthine packing, steam reservoir, steam leakage capturing means, steam leakage bypass means, and steam supply means are positioned between each of said discs.

* * * * *